US006341847B1

(12) United States Patent
Ohta et al.

(10) Patent No.: US 6,341,847 B1
(45) Date of Patent: Jan. 29, 2002

(54) ELECTROSTATIC INKJET HEAD HAVING AN ACCURATE GAP BETWEEN AN ELECTRODE AND A DIAPHRAGM AND MANUFACTURING METHOD THEREOF

(75) Inventors: Eiichi Ohta; Makoto Tanaka; Kohshi Nomura, all of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/401,043

(22) Filed: Sep. 22, 1999

(30) Foreign Application Priority Data

Sep. 24, 1998 (JP) ..... 10-269935

(51) Int. Cl.[7] ..... B41J 2/04
(52) U.S. Cl. ..... 347/54
(58) Field of Search ..... 347/54, 59, 68, 347/69, 70, 71, 72, 50; 29/890.1; 438/700; 216/27, 41; 399/261; 361/700; 310/328–330

(56) References Cited

U.S. PATENT DOCUMENTS 5,159,353 A * 10/1992 Fasen et al.
5,513,431 A 5/1996 Ohno
5,534,900 A 7/1996 Ohno et al.
5,576,251 A * 11/1996 Garabedian et al. ..... 437/228
5,652,609 A * 7/1997 Scholler et al.
5,666,142 A * 9/1997 Fujita et al.
5,980,025 A * 11/1999 Burke et al.
5,992,978 A * 11/1999 Fujii et al.
6,074,543 A * 6/2000 Yoshihira et al.
6,113,218 A * 9/2000 Atobe et al.

FOREIGN PATENT DOCUMENTS

JP 5-50601 3/1993
JP 6-71882 3/1994
JP 9-293861 A * 11/1997 ..... H01L/29/78

OTHER PUBLICATIONS

Griffiths, Introduction to Electrodynamics, 1989, Prentice–Hall, 2nd edition, p. 104.*

* cited by examiner

*Primary Examiner*—Raquel Yvette Gordon
(74) *Attorney, Agent, or Firm*—Greenberg Traurig, LLP

(57) ABSTRACT

An electrostatic inkjet head has an accurately controlled, uniform gap between a diaphragm and an electrode. The gap between the electrode and the diaphragm is defined by a depth of a depression formed in the diaphragm substrate or the electrode substrate. The depression is formed by removing an oxidation layer which is formed by selectively oxidizing a portion of the diaphragm substrate or the electrode substrate. The depth of the depression is determined by a thickness of a portion of the oxidation layer, which portion extends from a surface of the diaphragm substrate or the electrode surface. Since the thickness of the oxidation layer is accurately controlled, the depth of the depression is also accurately controlled. Accordingly, a dimension of the gap between the diaphragm and the electrode is extremely accurate.

18 Claims, 12 Drawing Sheets

(A)
54
5
50
51
(B)
52
(C)
53
(D)
55
(E)
54
56
(F)
7
57
55

(A)
54
5
50
51
(B)
52
(C)
53
(D)
55
(E)
54
66
7
(F)
57
55

ELECTROSTATIC INKJET HEAD HAVING AN ACCURATE GAP BETWEEN AN ELECTRODE AND A DIAPHRAGM AND MANUFACTURING METHOD THEREOF

BACKGROUND OF THE INVENTION

1. Field of the Invention

The present invention generally relates to an electrostatic actuator and, more particularly, to an electrostatic inkjet head having an electrostatic actuator including a diaphragm driven by an electrode located adjacent to the diaphragm with a small gap therebetween. The electrostatic actuator according to the present invention is preferably used for an inkjet head of a high-quality color image printer, a micro-pump or a micro-pressure sensor.

2. Description of the Related Art

As an on-demand type inkjet head, a piezo on-demand type inkjet head and a bubble-jet type inkjet head are popular. The piezo on-demand type inkjet head uses a piezoelectric element to drive a diaphragm which constitutes a fluid chamber storing ink so that a droplet of the ink is discharged from the fluid chamber when the piezoelectric element is driven. The bubble-jet type inkjet head uses a heating element provided in a fluid chamber so as to generate bubbles in ink stored in the fluid chamber by heating the heating element so that the ink in the fluid chamber is discharged by the pressure caused by the bubbles. However, the piezo on-demand type inkjet head and the bubble-jet type inkjet head must be inexpensive and have a very small size and high operating speed. Additionally, a higher density and a higher image quality are also required of such inkjet heads.

In order to achieve the above-mentioned requirements, electrostatic inkjet heads using an electrostatic actuator have been suggested. In the electrostatic inkjet head, an electrostatic actuator is constituted by a diaphragm defining a fluid chamber and an electrode situated adjacent to the diaphragm. Pressure of ink in the fluid chamber is increased so as to discharge the ink from the fluid chamber by displacing the diaphragm by applying an electrostatic force generated by the electrode.

Japanese Laid-Open Patent Application No.5-50601 discloses an electrostatic inkjet head. The electrostatic inkjet head is constituted by an upper substrate made of silicon and a lower substrate. A nozzle, a discharge chamber, an ink cavity a diaphragm and an ink supply opening are provided in the upper substrate. An electrode is provided in the lower substrate. The upper substrate and the lower substrate are joined so that the electrode is opposite to the diaphragm with a small gap therebetween. An electric field is applied between the diaphragm and the electrode so as to generate an electrostatic attractive force.

Additionally, Japanese Laid-Open Patent Application discloses an electrostatic inkjet head having a gap between a diaphragm and an electrode. The gap is 0.05 $\mu$m to 2.0 $\mu$m so that the inkjet head can have a small size and high density and is driven by a low voltage. The gap is defined by a recess formed in a silicone oxide film ($SiO_2$) by an etching method.

However, in the above-mentioned inkjet heads, it is difficult to maintain a uniform gap when a plurality of gaps are formed within a few millimeters of each other. Additionally, the gap is determined by a depth of etching when a silicon (Si) substrate or a glass substrate is etched. The depth of etching is controlled by an etching time and depends on a temperature of an etchant, concentration of the etchant and the etching time. Since the gap is controlled by controlling the etching time when a part of a silicon oxide film or a glass film is etched, dispersion of the gap is also large.

In additionally, if a glass substrate is used, a very small scratch, which is produced when the glass substrate is polished and cannot be identified by a visual check, is produced. Such a scratch causes a relatively large recess when an etchant enters the flaw.

Additionally, when a protective film is formed by a thin-film forming process, a surface roughness is unsatisfactory (unevenness of a surface is about 2,000 Å), and it cannot be a uniform gap.

SUMMARY OF THE INVENTION

In order to overcome the problems identified above, preferred embodiments of the present invention provide an improved and useful electrostatic inkjet head in which a gap between a diaphragm and an electrode is accurately controlled and made to have a uniform size.

In order to achieve the above-mentioned objects, there is provided according to one aspect of preferred embodiments of the present invention, an inkjet head which is constructed to eject a droplet of ink from a pressurizing chamber by pressurizing the ink in the pressurizing chamber by displacing a diaphragm defining a portion of the pressurizing chamber. The diaphragm is preferably displaced via application of an electrostatic force generated by an electrode disposed opposite to the diaphragm. The diaphragm and the electrode are arranged such that there is a predetermined gap between the diaphragm and the electrode. The inkjet head preferably includes a diaphragm substrate having the diaphragm provided therein so that the diaphragm includes a bottom portion of the diaphragm substrate and an electrode substrate connected to the diaphragm substrate so that the electrode faces the diaphragm of the diaphragm substrate, the electrode substrate having a depression arranged such that the electrode defines a bottom of the depression and the predetermined gap is defined by a depth of the depression. The depression is preferably formed by removing an oxidation layer which is formed by selectively oxidizing a portion of the electrode substrate.

Additionally, there is provided according to another aspect of preferred embodiments of the present invention an inkjet head with a similar construction as that of the inkjet head described in the preceding paragraph, the inkjet head including an electrode substrate having the electrode on a top surface thereof and a diaphragm substrate connected to the electrode substrate so that the electrode of the electrode substrate faces the diaphragm provided in the diaphragm substrate, the diaphragm substrate having a depression so that the diaphragm is defines a bottom portion of the depression and a depth of the depression defines the predetermined gap. The depression is preferably formed by removing an oxidation layer which is formed by selectively oxidizing a portion of the diaphragm substrate.

According to preferred embodiments of the present invention, the gap between the electrode and the diaphragm is defined by the depth of the depression formed in the diaphragm substrate or the electrode substrate. The depression is preferably formed by removing an oxidation layer which is formed by selectively oxidizing a portion of the diaphragm substrate or the electrode substrate. That is, the depth of the depression is preferably determined by a thickness of a portion of the oxidation layer, which portion extends from a surface of the diaphragm substrate or the electrode surface. In one preferred embodiment, such a portion of the oxidation layer is preferably about 44% of the overall thickness of the oxidation layer. Since the thickness of the oxidation layer can be accurately controlled, the depth of the depression which is formed by removing the oxidation layer can also be accurately controlled. Accordingly, the gap between the diaphragm and the electrode can be formed with great accuracy and reliability in the preferred embodiments of the present invention. Thus, the inkjet head according to preferred embodiments of the present invention has uniform and reliable characteristics.

Other elements, features and advantages of the present invention will become more apparent from the following detailed description when read in conjunction with the accompanying drawings.

DETAILED DESCRIPTION OF PREFERRED EMBODIMENTS

Figure 1A:
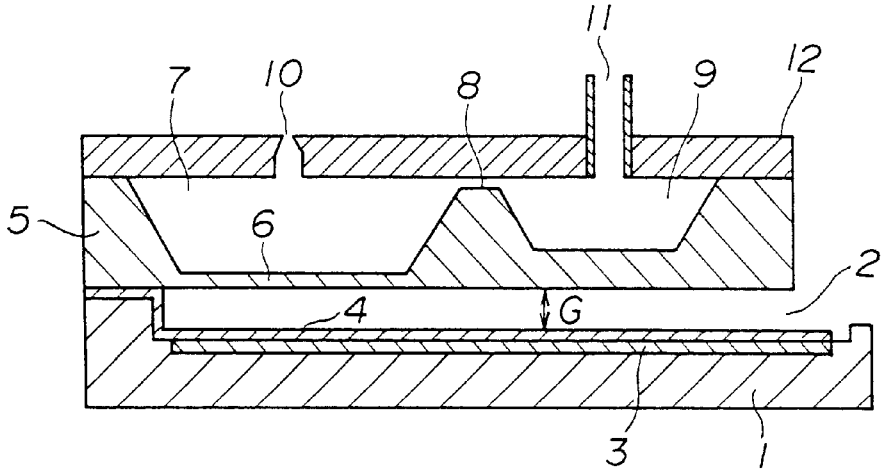
FIG. 1A is a cross-sectional view of an inkjet head according to a first preferred embodiment of the present invention.
Figure 1B:
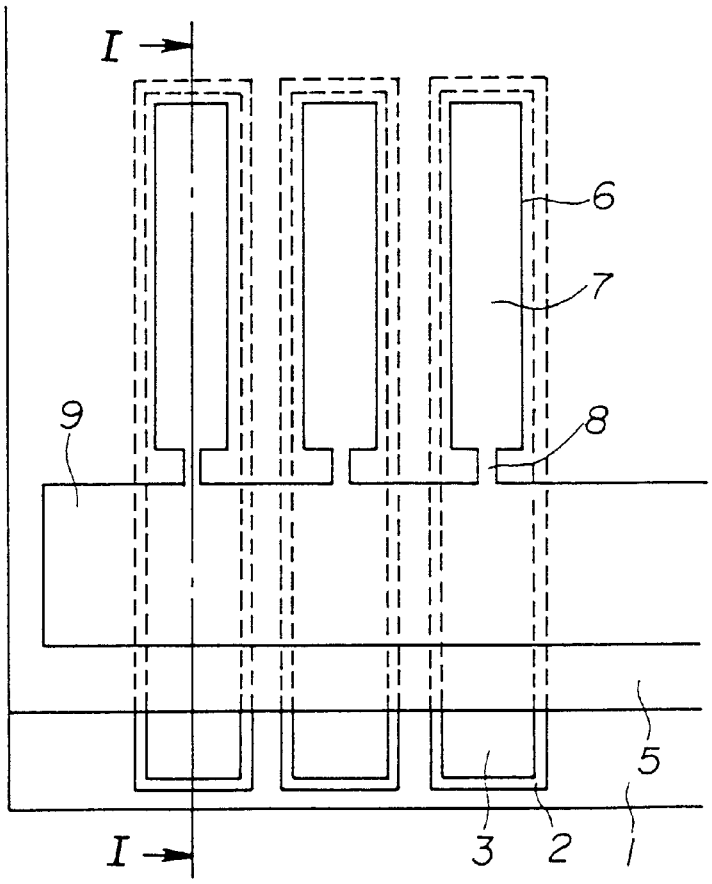
FIG. 1B is a plan view of a portion of the inkjet head shown in FIG. 1A in which a top substrate is removed.

A description will now be given, with reference to FIGS. 1A and 1B, of a first preferred embodiment of the present invention. FIG. 1A is a cross-sectional view of an inkjet head according to the first preferred embodiment of the present invention. FIG. 1B is a plan view of a part of the inkjet head shown in FIG. 1A in which a top substrate is removed. It should be noted that the cross-sectional view of FIG. 1A is taken along a line I—I of FIG. 1B.

As shown in FIG. 1A, the inkjet head according to the first preferred embodiment of the present invention preferably includes an electrode substrate 1, a diaphragm substrate 5 and a top substrate 12. The electrode substrate 1 is provided with a depression 2, and an electrode 3 is formed on the bottom surface of the depression 2. A protective film 4 is preferably provided on a surface of the electrode substrate 1 including the electrode 3.

The diaphragm substrate 5 has a diaphragm 6 provided on the bottom portion of the diaphragm substrate 5. The diaphragm substrate 5 is joined to the electrode substrate 1 so that the diaphragm 6 faces the electrode 3 (protective film 4) with a small gap G defined therebetween. That is, the small gap G is defined by a depth of the depression 2 formed in the electrode substrate 1. The top substrate 12 is joined to a top surface of the diaphragm substrate so that a pressurizing chamber 7, a fluid passage 8 and a common fluid chamber 9 are provided in the diaphragm substrate 5. A discharge opening 10 is formed in the top substrate 12 so that the discharge opening 10 is connected to the pressurizing chamber 7. An inlet opening 11 is also formed in the diaphragm substrate 12 so that the inlet opening is connected to the common fluid chamber 9.

It should be noted that the structure shown in FIG. 1A is preferably a unit structure of the inkjet head, and the inkjet head is constituted by a plurality of the unit structures. The unit structure is generally referred to as a bit.

In the inkjet head according to preferred embodiments of the present invention, the pressurizing chamber 7 is filled with ink supplied via the common fluid chamber 9 and the fluid passage 8. An electric field is generated between the diaphragm 6 and the electrode 3 so as to elastically deform the diaphragm 6 by application of an electrostatic force. When the electric field is removed, the deformed diaphragm 6 returns to its original position. Accordingly, the ink in the pressurizing chamber 7 is pressurized by the returning force of the diaphragm 7, and a droplet of the ink is ejected from the discharge opening 10.

In the above-mentioned structure of the inkjet head, the small gap G is an important factor which determines an amount of elastic deformation of the diaphragm 6. If the gap G fluctuates, a characteristic of ejection of the ink may vary undesirably. Additionally, if a surface of the electrode 3 or the protective film 4 is rough, an electric field is concentrated at a protruding portion of the surface which results in a local deformation of the diaphragm 6. Further, if the protective film 4 has low quality with respect to an insulating characteristic, an insulation destruction may occur at a relatively low voltage when the diaphragm 6 contacts the protective layer 4. If an interface between the electrode 3 and the protective film 4 is bad, an electric charge occurs in the interface. In such a case, a residual electric charge is generated, and, thereby, the movement of the diaphragm 6 is delayed by a certain time delay.

Figure 2:
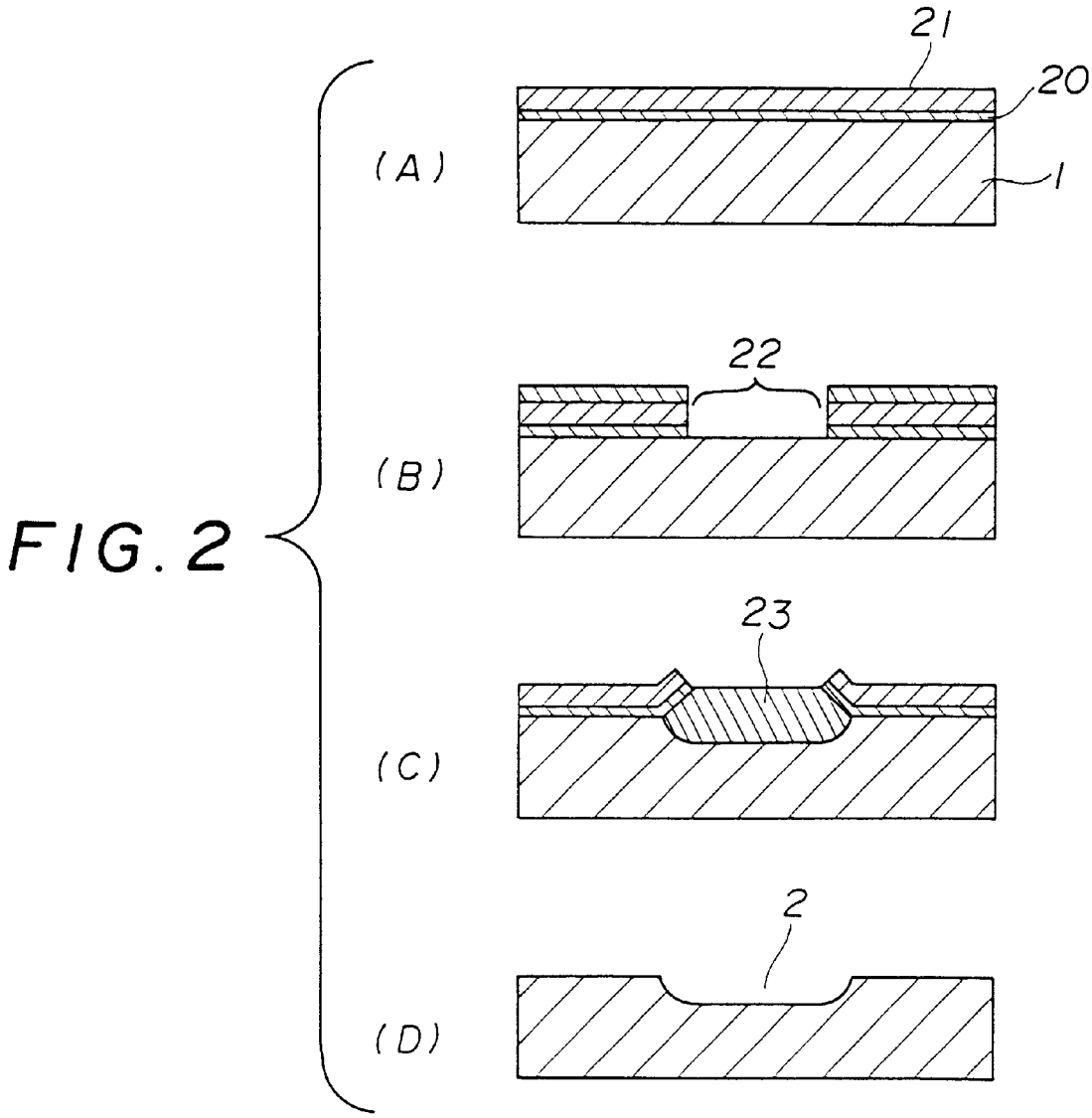
FIG. 2 is an illustration for explaining a process of forming a depression which defines a small gap between a diaphragm and an electrode for use in preferred embodiments of the present invention.

FIG. 2 is an illustration for explaining one preferred embodiment of a process of forming the depression 2 which defines the small gap G between the diaphragm 6 and the electrode 3 according to preferred embodiments of the present invention.

First, as shown in FIG.2-(A), a buffer oxidation film 20 and a nitride film 21 are formed on a surface of the electrode substrate 1. Then, a resist opening is formed by photolithography which resist opening has a pattern corresponding to the depression 2 to be formed. The nitride film 21 and the buffer oxidation film 20 are sequentially removed by etching so as to form an oxidizing area 22 as shown in FIG.2-(B). The remaining nitride film 21 and the remaining buffer oxidation film 20 function as mask layers when the oxidizing area 22 is oxidized. It should be noted that, in an example, the electrode substrate 1 was formed by a (100) silicon (Si) substrate having a thickness of about 525 $\mu$m and having a mirror surface on one side thereof. However, the thickness of the silicon substrate is not limited to such a thickness, and there is no limitation to the plane orientation of the silicon substrate.

The silicon (Si) substrate is thermally oxidized at 1100° C. in an oxygen and steam atmosphere so as to form an oxidation film 23 in the oxidizing area 22 as shown in FIG. 2-(C). The growth rate of the oxidation film 23 is 1 $\mu$m per four (4) hours. The growth rate may vary according to the atmosphere or the oxidizing temperature. Thereafter, only the oxidation film 23 is selectively etched by a dry etching method using an HF-etchant or an F-etchant. As a result, the depression 2 is formed on the electrode substrate 1 as shown in FIG. 2-(D).

In the present preferred embodiment, the accuracy of the depth of the depression 2 is determined by a thickness of the oxidation layer 23 formed on the electrode substrate. More specifically, the accuracy of the depth of the depression 2 is determined by a thickness of a portion of the oxidation film 23 which portion grows within the silicon (Si) substrate. Generally, a thickness of a heat-oxidation film can be controlled with a high accuracy as high as about ±3%. Accordingly, higher accuracy, better repeatability and lower dispersion of the depth of the depression 2 are achieved with this preferred embodiment of the present invention as compared to a conventional process for producing the depression 2.

Additionally, in another preferred embodiment of the present invention, the inventors discovered that the advantages of accuracy, repeatability and dispersion of depth are guaranteed when a thickness of a portion of the oxidation film, which portion grows toward the inside of the silicon substrate, is about 44% of the thickness of the entire oxidation film. Thus, it is easy to determine a process condition by which a desired depth of the depression 2 can be obtained.

In the above-mentioned preferred embodiment, the depression 2 is preferably formed on the electrode substrate 1. However, the depression defining the small gap G between the electrode 3 and the diaphragm 6 may be formed in the diaphragm substrate 5 instead of the electrode substrate 1.

Figure 3:
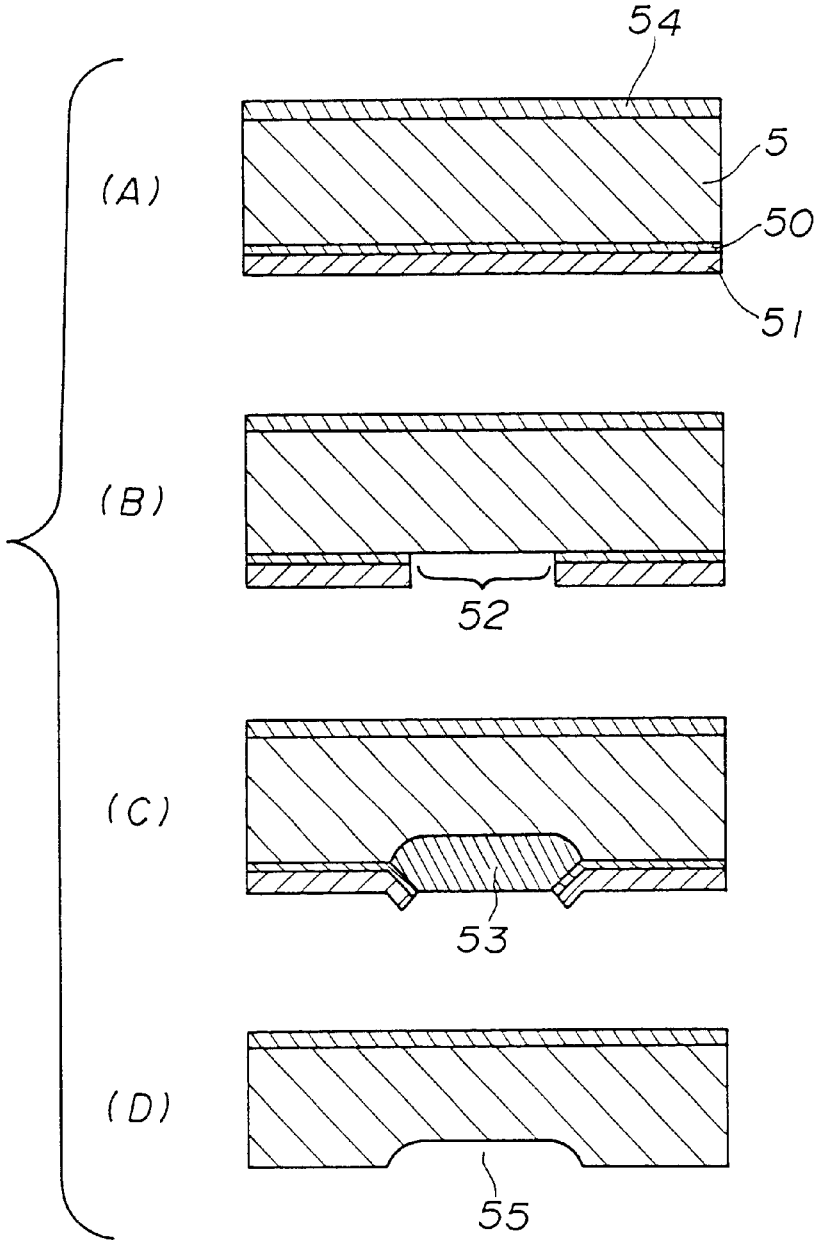
FIG. 3 is an illustration for explaining a process of producing a depression in a diaphragm substrate for use in preferred embodiments of the present invention.

A description will now be given, with reference to FIG. 3, of a second preferred embodiment of the present invention. In the second preferred embodiment, the depression defining the small gap G is formed in the diaphragm substrate 5. FIG. 3 is an illustration for explaining one preferred embodiment of a process of producing the depression 55 in the diaphragm substrate 5.

First, as shown in FIG. 3-(A), a buffer oxidation film 50 and a nitride film 51 are formed on a surface of the diaphragm substrate 5. Then, a resist opening is formed by photolithography which resist opening has a pattern corresponding to the depression 55 to be formed. The nitride film 51 and the buffer oxidation film 50 are sequentially removed by etching so as to form an oxidizing area 52 as shown in FIG. 30(B). The remaining nitride film 51 and the remaining buffer oxidation film 50 function as mask layers when the oxidizing area 52 was oxidized. It should be noted that, in an example of this preferred embodiment, the diaphragm substrate 1 was formed by a (110) silicon (Si) substrate having a thickness of about 400 $\mu$m and having a mirror surface on one side thereof. However, the thickness of the silicon substrate is not limited to such a thickness. The plane orientation (110) of the silicon substrate is preferable so as to achieve a high density nozzle arrangement.

The silicon (Si) substrate is thermally oxidized at 1100° C. in an oxygen and steam atmosphere so as to form an oxidation film 53 in the oxidizing area 52 as shown in FIG. 3-(C). The growth rate of the oxidation film 53 is 1 $\mu$m per four (4) hours. The growth rate may vary according to the atmosphere or the oxidizing temperature. Thereafter, only the oxidation film 53 is selectively etched by a dry etching method using an HF-etchant or an F-etchant. As a result, the depression 55 is formed on the diaphragm substrate 5 as shown in FIG. 3-(D).

In the present preferred embodiment, an accuracy of a depth of the depression 55 is determined by a thickness of the oxidation layer 53 formed on the diaphragm substrate 5. More specifically, the accuracy of the depth of the depression 55 is determined by a thickness of a portion of the oxidation film 53 which portion grows within the silicon (Si) substrate. Generally, a thickness of a heat-oxidation film can be controlled with a high accuracy as high as about ±3%. Accordingly, higher accuracy, better repeatability and lower dispersion of the depth of the depression 55 are achieved with this preferred embodiment of the present invention as compared to a conventional process for producing the depression 2.

Additionally, in another preferred embodiment of the present invention, the inventors discovered that the advantages of accuracy, repeatability and dispersion of depth are guaranteed when a thickness of a portion of the oxidation film, which portion grows toward the inside of the silicon substrate, is about 44% of the thickness of the entire oxidation film. Thus, it is easy to determine a process condition by which a desired depth of the depression 55 can be obtained.

In the inkjet head according to the above-mentioned first or second preferred embodiments, an electrostatic pressure f exerted on the diaphragm 6 is represented by the following equation:

$$f=\frac{1}{2}\cdot\epsilon_{\circ}\cdot(V/t)^2.$$

Where $\epsilon_{\circ}$ is the electric constant; V is a voltage applied to the electrode, t is a gap between the diaphragm and the electrode.

As appreciated from the above-mentioned equation, the electrostatic force f can be increased by decreasing the gap t. However, when the gap t is too small, the diaphragm 6 contacted the electrode before a necessary deformation occurred in the diaphragm 6. Considering this point, it was discovered that a lower limit of a range of gap t is about 0.04 $\mu$m. In certain preferred embodiments of the present invention, Additionally, in another preferred embodiment of the present invention, the greatly improved accuracy, repeatability and dispersion of depth are guaranteed when a thickness of a portion of the oxidation film, which portion grows toward the inside of the silicon substrate, is about 44% of the thickness of the entire oxidation film. According to this relationship, a lower limit of a range of the thickness of the oxidation film 23 or 53 is about 0.1 $\mu$m.

Additionally, if the oxidation film is too thick, a time for forming the oxidation film is too long which condition is not appropriate for mass production. Additionally, there is a problem in that a stress generated inside the oxidation film is too large so that various defects appear in the substrate. Considering these points, it is found that the upper limit of the range of the thickness of the oxidation film is about 7 $\mu$m.

Figure 4:
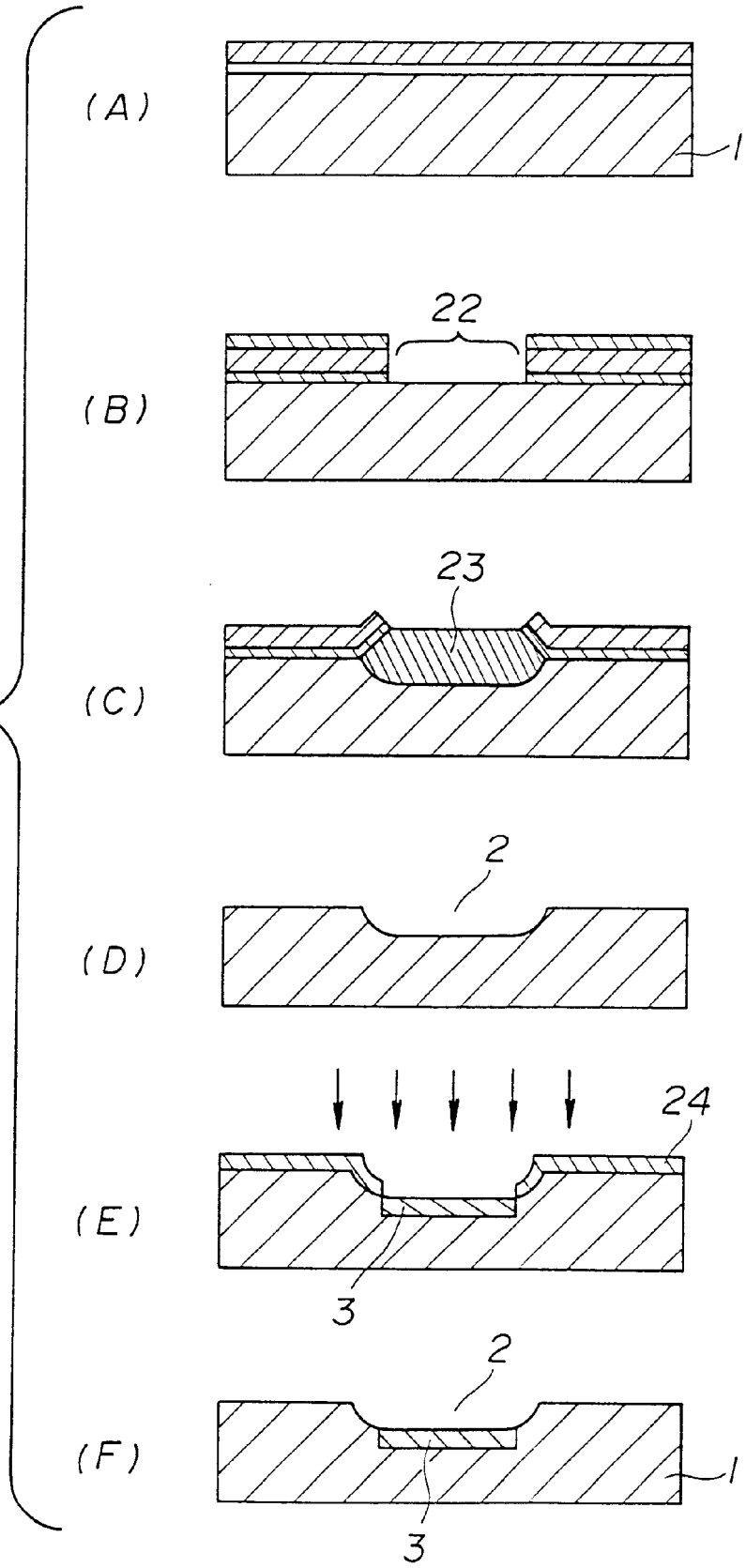
FIG. 4 is an illustration for explaining a process of producing the small gap between the electrode and the diaphragm for use in preferred embodiments of the present invention.

A description will now be given, with reference to FIG. 4, of a process of producing the depression 2 in the electrode substrate 1 according to one preferred embodiment of the present invention. FIG. 4 is an illustration for explaining the process of producing the small gap G between the electrode 3 and the diaphragm 6.

As shown in FIG. 1B, a plurality of electrodes 3 are arranged close to each other in a transverse direction of the inkjet head. Each of the electrodes 3 is preferably defined by an impurity diffusion layer. When the electrode substrate 1 is made of a p-channel semiconductor, the electrode 3 is made of an n-channel impurity diffusion layer. On the other hand, when the electrode substrate 1 is made of an n-channel semiconductor, the electrode 3 is made of a p-channel impurity diffusion layer. When a drive voltage is applied to the electrodes 3 of adjacent bits, a depletion layer expands from the impurity diffusion layer within the electrode substrate 1 in each of the adjacent bits. Although it depends on a level of the voltage and an amount of impurity in the impurity diffusion layer, the depletion layer generated by one of the adjacent bits may reach the depletion layer generated by the other one of the adjacent bits. This phenomenon is referred to as a bit-to-bit leakage. According to calculations by the inventors, a width of the depletion layer reaches as large as 10 to 15 $\mu$m when the voltage is 150 V and the impurity concentration is $1\times10^{15}$ atoms/cm$^3$. Additionally, when the impurity diffusion layer is formed, the impurity atoms diffuse in a transverse direction as well as a direction of depth, and, thereby, the possibility of the bit-to-bit leakage is further increased.

In preferred embodiments of the present invention, in order to eliminate the above-mentioned problem, the impurity diffusion layer forming the electrode 3 is preferably formed within opposite edges of the oxidation film 23, that is, within opposite edges of the depression 2 as shown in FIG. 4-(F).

The process of FIG. 4-(A) to 4-(D) is the same as the process of FIG. 2-(A) to 2-(D), and description thereof will be omitted. After the process of FIG. 4-(A) to 4-(D) was completed, a resist layer 24 was formed by a spin coating method, and an opening pattern corresponding to the electrode 3 was formed. Then, phosphorus (P) atoms (or arsenic (As) atoms) were implanted under a condition of 70 KeV and $5\times10^{15}$ atoms/cm$^3$. After the resist layer 24 was removed, the impurity diffusion layer was formed by activating the implanted area at 1000° C. for 60 minutes. In the above-mentioned process, the electrode 3 was formed in a p-channel semiconductor substrate. If an n-channel semiconductor substrate is used, boron (B) atoms or antimony (Sb) atoms may be selected as the atoms to be implanted. Additionally, the electrode 3 does not always have to be formed of an impurity diffusion layer. As an alternative, a heat-resistive conductor (more than 500° C.) such as tungsten (W), Tantalum (Ta), or titanium nitride (TiN) provided on an insulating layer may be used.

A description will now be given, with reference to FIG. 5, of another process of forming the depression 2 and the electrode 3 according to another preferred embodiment of the present invention.

Figure 5:
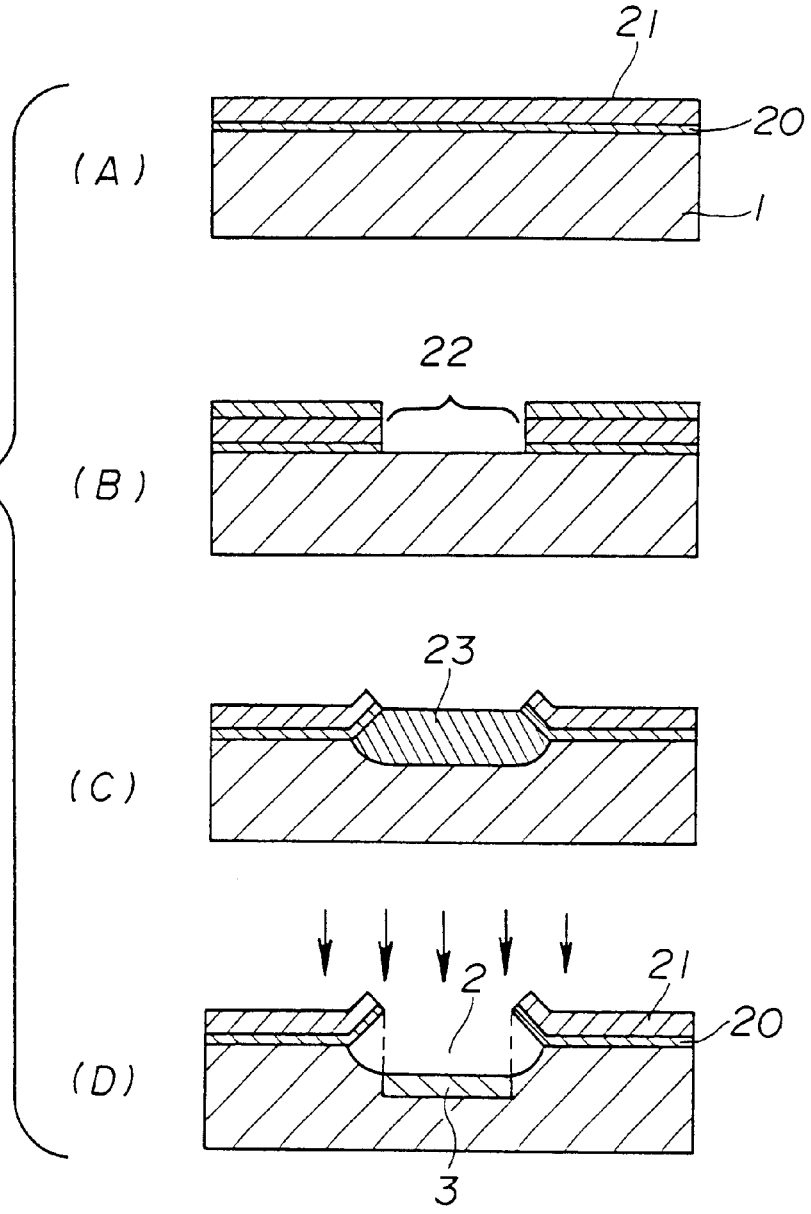
FIG. 5 is an illustration for explaining a process of forming the depression and the electrode for use in preferred embodiments of the present invention.

First, as shown in FIG. 5-(A), a buffer oxidation film 20 and a nitride film 21 are formed on a surface of the electrode substrate 1. Then, a resist opening is formed via photolithography, which resist opening has a pattern corresponding to the depression 2 to be formed. The nitride film 21 and the buffer oxidation film 20 are sequentially removed by etching so as to form an oxidizing area 22 as shown in FIG. 5-(B). The remaining nitride film 21 and the remaining buffer oxidation film 20 function as mask layers when the oxidizing area 22 is oxidized. It should be noted that in one example of this preferred embodiment, the electrode substrate 1 was formed by a (100) silicon (Si) substrate having a thickness of about 525 $\mu$m and having a mirror surface on one side. However, the thickness of the silicon substrate is not limited to such a thickness, and there is no limitation to the plane orientation of the silicon substrate.

The silicon (Si) substrate is thermally oxidized at 1100° C. in an oxygen and steam atmosphere so as to form an oxidation film 23 in the oxidizing area 22 as shown in FIG. 5-(C). The growth rate of the oxidation film 23 is 1 $\mu$m per four (4) hours. The growth rate may vary by the atmosphere or the oxidizing temperature. Thereafter, only the oxidation film 23 is selectively etched by a dry etching method using an HF-etchant or an F-etchant. As a result, the depression 2 is formed on the electrode substrate 1 as shown in FIG. 5-(D).

Thereafter, impurity atoms are implanted without removing the remaining buffer oxidation film 20 and the remaining nitride film 21. That is, the remaining buffer oxidation film 20 and the remaining nitride film 21 are used as mask layers so that opposite edges of an impurity diffusion layer which defines the electrode 3 are automatically aligned with edges of the mask layers in a direction of implantation as shown in FIG. 5-(D). Accordingly, there is no need to form a mask layer exclusively for the implantation process, and, thus, the process is simplified and a manufacturing cost is reduced.

A description will now be given, with reference to FIG. 6, of a process of joining the diaphragm substrate 5 to the electrode substrate 1 according to a preferred embodiment of the present invention.

Figure 6:
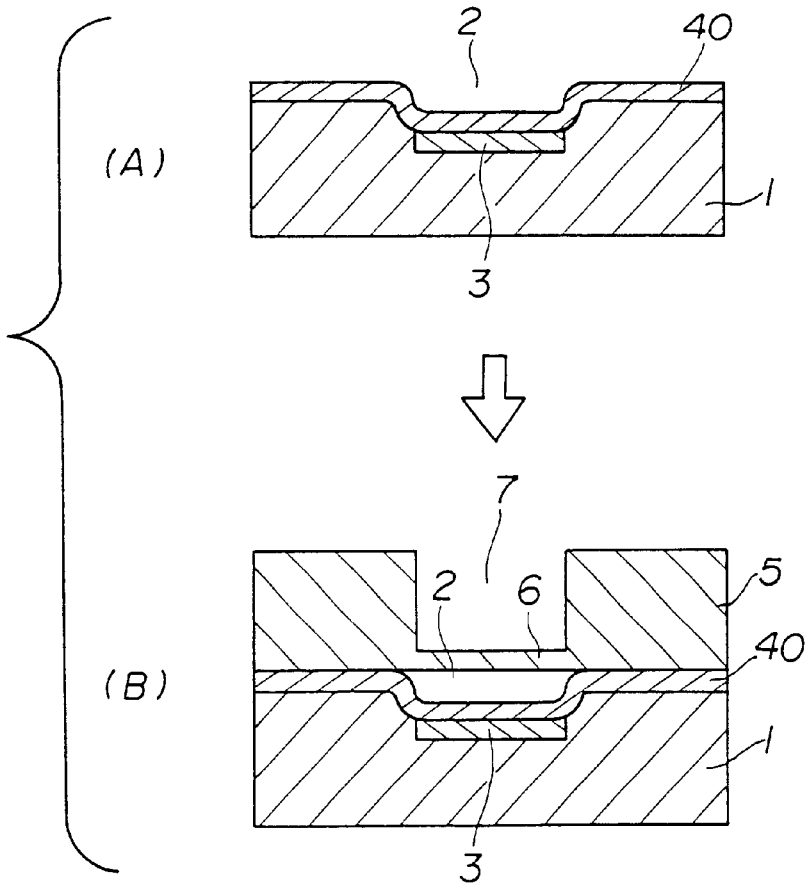
FIG. 6 is an illustration for explaining a process of joining the diaphragm substrate to the electrode substrate for use in preferred embodiments of the present invention.

First, an oxidation film or a nitride film which serves as a protective and joining layer 40 is preferably formed on an entire surface of the electrode substrate 3 as shown in FIG. 6-(A) after the depression 2 and the electrode are formed on the electrode substrate 1. Thereafter, the diaphragm substrate 5 in which the diaphragm 6 and the pressurizing chamber 7 are already formed is joined to the electrode substrate 1 via the protective and joining layer 40 as shown in FIG. 6-(B).

A description will now be given of the protective and joining layer 40 in detail. When each of the electrode substrate 1 and the diaphragm substrate 5 is formed of a silicon (Si) substrate, it is required to join the electrode substrate 1 and the diaphragm substrate 5 by a direct bonding technique of silicon-to-silicon. Normally, the direct bonding of silicon-to-silicon is performed by annealing the silicon substrates at 1100° C. in a nitrogen gas ($N_2$) atmosphere after the silicon substrates are pre-bonded to each other. However, since the inkjet head according to preferred embodiments of the present invention uses an impurity diffusion layer or a metal having a high melting point such as a titanium silicide to define the electrode 3, a characteristic of the electrode 3 is undesirably changed at such a temperature as high as 1100° C. In the process of producing the inkjet head according to preferred embodiments of the present invention, the bonding of the electrode substrate 1 and the diaphragm 5 must be performed under an annealing condition of less than 800° C. In order to achieve such a bonding at a low temperature, the protective and joining layer 40 made of an oxidation film or a nitride film is provided between the silicon substrates and a pre-bonding is performed under a vacuum so as to prevent atmospheric gasses from entering the interface between the silicon substrates.

More specifically, the protective and joining layer 40 is provided by forming an oxidation film or a nitride film on an entire surface of the electrode substrate 1. The electrode substrate 1 and the diaphragm substrate 5 are cleaned by a mixture of an ammonia solution and a hydrogen peroxide solution or a mixture of a sulfuric acid solution and a hydrogen peroxide solution so as to cover the surfaces of the electrode substrate 1 and the diaphragm substrate 5 by hydroxyl (OH) groups. At this stage, the protective and joining layer 40 serves as an adsorbing site which preferably adsorbs the hydroxyl groups. Thereafter, the electrode substrate 1 and the diaphragm substrate 5 are aligned to each other, and pressed against each other in a vacuum so as to pre-bond the substrates 1 and 5 by utilizing a hydrogen bonding of the hydroxyl groups. Thereafter, the pre-bonded substrates 1 and 5 are annealed at 800° C. for one hour in a vacuum or an atmospheric pressure. In this manner, the substrates 1 and 5 can be firmly bonded without generation of voids. A voltage may be applied to both the substrates 1 and 5 while the annealing is performed so that the substrates 1 and 5 are pressed against each other by an electrostatic force. This condition achieves bonding at a lower temperature.

As far as a strength of bonding is concerned, the bonding performed in preferred embodiments of the present invention does not require a strong bonding at an atom level which is achieved in a normal bonding of silicon wafers. A primary requirement in the bonding of preferred embodiments of the present invention is elimination of voids in the bonded area.

Additionally, another function of the protective and joining layer 40 is to define a protection of the electrode 3. If the protective and joining layer 40 is not provided over the electrode 3, a short circuit may occur between the electrodes and the diaphragm 6 when the diaphragm 6 deforms too much. Accordingly, the protective and joining layer 40 formed of an oxidation film or a nitride film increases the bonding ability of the substrates when the substrates are subjected to the direct bonding and also provides a protection to the electrode 3 formed on the electrode substrate 1.

In order to achieve such a protecting function, the protective and joining layer 40 preferably has a thickness of at least about 0.05 $\mu$m when a drive voltage is about 35 V. However, if the thickness of the protective and joining layer 40 is too large, a characteristic of the electrostatic inkjet head may be deteriorated due to the following problems that occur when the bonding is performed. That is, when the thickness of the protective and joining layer 40 is too large, 1) the electrode substrate 1 is warped which causes generation of voids and 2) an undesired stress is generated in the diaphragm 6 due to a difference in thermal expansion between the protective and joining layer 40 and the silicon substrate. Considering the above-mentioned conditions, the thickness of the protective and joining layer 40, which is made of an oxidation film or a nitride film, is preferably in a range from about 0.05 $\mu$m to about 0.5 $\mu$m in practice. More preferably, the thickness of the protective and joining layer 40 is in a range from about 0.07 $\mu$m to about 0.4 $\mu$m in practice when considering a process margin of an dielectric voltage and a stress of the oxidation film or the nitride film, a manufacturing cost and an yield rate of the inkjet head.

The protective and joining layer 40 may be formed in a multi-layered structure of an oxidation film and a nitride film so as to increase a dielectric voltage and a resistance to various environments. In such a case, a thickness of the oxidation film is preferably about 500 Å to about 2,000 Å, and a thickness of the nitride film is preferably about 500 Å to about 1,000 Å. The oxidation film can be formed by a normal thermal oxidation or various chemical vapor deposition (CVD) methods. The nitride film can be formed by a thermal CVD method or physical CVD method.

A description will now be given, with reference to FIG. 7, of a process of forming the diaphragm substrate 5 which has the depression 55 to define the small gap G between the electrode and the diaphragm according to a preferred embodiment of the present invention.

Figure 7:
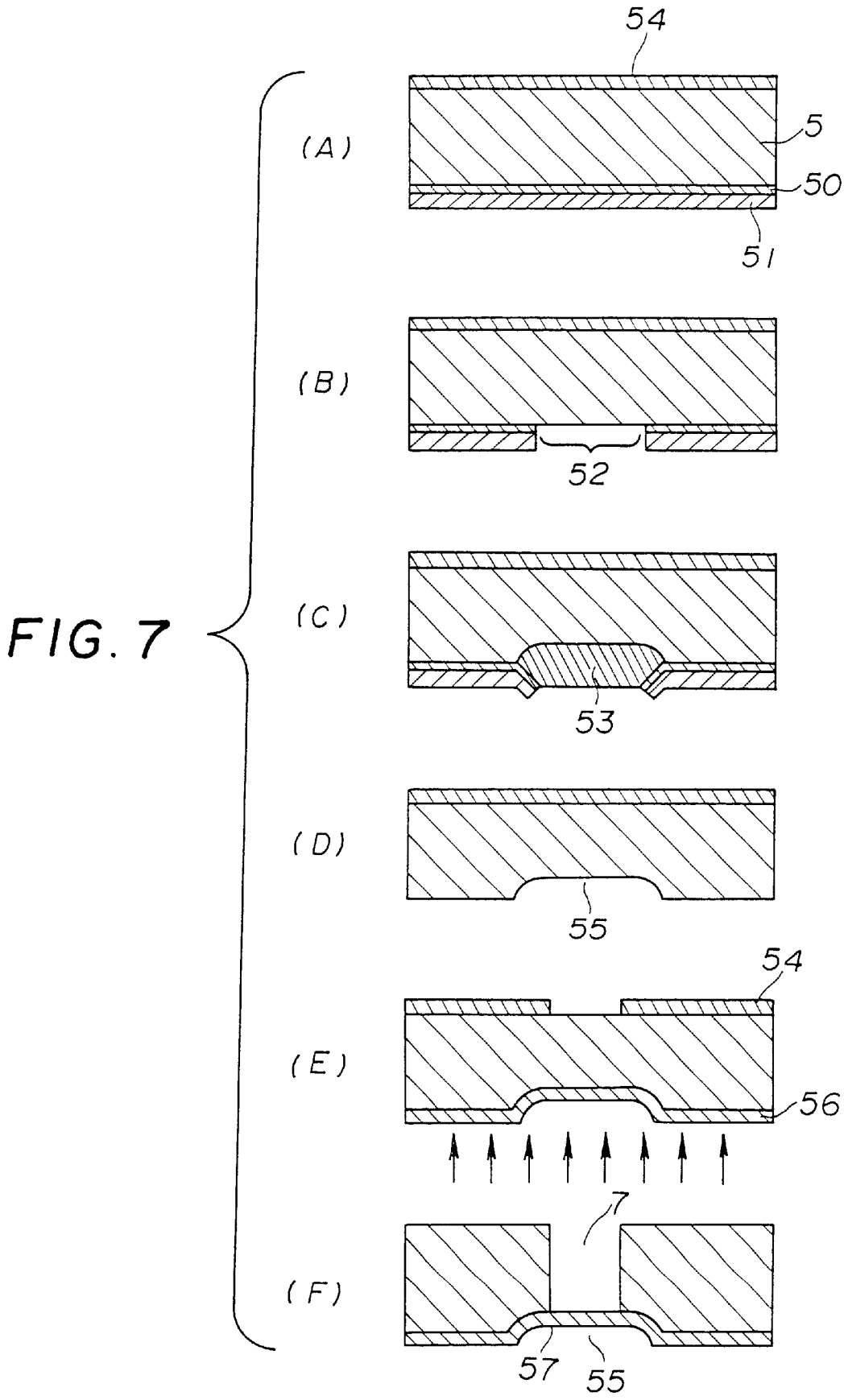
FIG. 7 is an illustration for explaining a process of forming the diaphragm electrode which has a depression to define the small gap between the electrode and the diaphragm for use in preferred embodiments of the present invention.

The process of FIG. 7-(A) to 7-(D) is preferably the same as the process of FIG. 3-(A) to 3-(D), and a description thereof will be omitted. After the depression 55 is formed on the diaphragm substrate 5, a boron (B) diffusion layer 56, which is a p-channel impurity diffusion layer, is formed on an entire bottom surface of the diaphragm substrate 5. The boron diffusion layer 56 functions as an etching prevention layer when the diaphragm 57 is formed by an anisotropic etching of the silicon substrate. Thereby, the diaphragm 57 can be formed to have a uniform thickness.

The boron diffusion layer 56 can be formed by a normal impurity diffusion method. If a gas diffusion method is used, the following process is preferably used.

First, the diaphragm electrode 5 is placed in a diffusion furnace. Boron bromide gas ($BBr_3$) and oxygen gas ($O_2$) are introduced into the diffusion furnace with nitrogen gas ($N_2$) as a carrier gas so as to perform a boron deposit at 1,100° C. for a predetermined period. Thereafter, activation within an oxygen atmosphere is performed so as to form the boron diffusion layer 56. The boron diffusion layer 56 can also be formed by ion implantation with a drive voltage of 100 KeV and a diffusion temperature of 1,000° C. The concentration of the boron atoms is preferably more than $1\times10^{20}$ atoms/$cm^3$, and a thickness of the boron diffusion layer 56 is preferably about 1 $\mu$m to about 10 $\mu$m. In a case in which the concentration of the boron atoms is high and a depth of dope is large, that is, the diaphragm is thick, a gas diffusion by an ion implantation, a spin coating of boron oxide ($B_2O_3$) or solid diffusion using a boron nitride (BN) plate may be suitable.

Thereafter, an opening is formed in the mask layer 54 which is formed on a surface opposite to the surface on which the boron diffusion layer 56 is formed. The pattern of the opening corresponds to the pattern of the diaphragm 57 to be formed. Thereafter, the silicon substrate under the opening is removed by an alkaline anisotropic etching method using a potassium hydroxide (KOH) solution (10–30 wt %) at a temperature of about 80° C. to about 90° C. An etching rate of the silicon substrate etched by the alkaline etching depends on the concentration of the boron atoms. In the normal silicon substrate, the etching rate in a normal silicon substrate (a medium resistance substrate) is about 1 $\mu$m/min to about 2 $\mu$m/min while the etching rate in the high-concentration area reaches as low as about 0.01 $\mu$m/min. Accordingly, when the etching reaches the boron diffusion layer 56, progress of the etching substantially stops. Thus, the diaphragm 57 can be produced to have a uniform thickness. It should be noted that an ethylenediamine pyrocatecol (EDP) solution can be preferably used as the etchant.

A description will now be given, with reference to FIG. 8, of another process of forming the diaphragm 6 according to a preferred embodiment of the present invention. In the above-mentioned process, the boron diffusion layer 56 is formed on an entire surface of the silicon substrate. On the other hand, in the process shown in FIG. 8, a diffusion layer is formed in an area which solely corresponds to the diaphragm 6.

Figure 8:
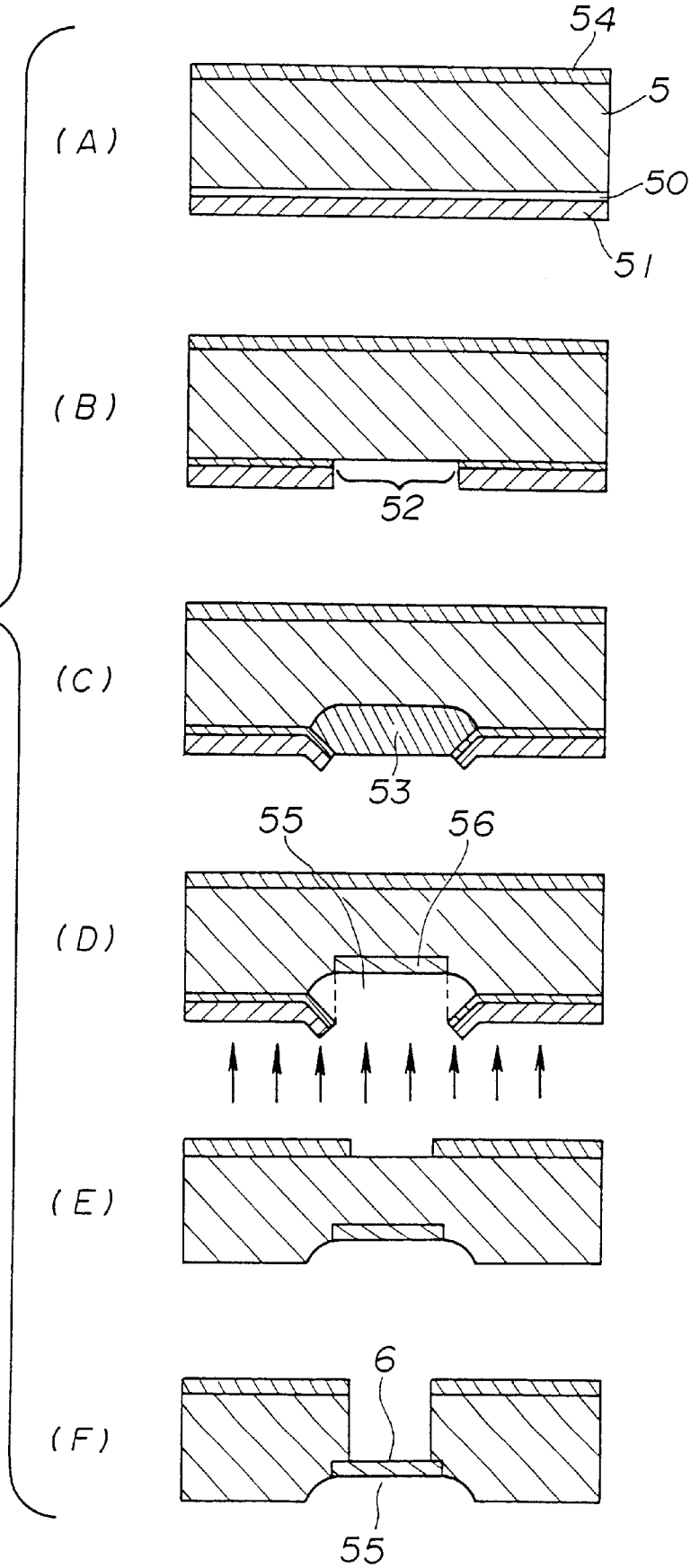
FIG. 8 is an illustration for explaining a process of forming the diaphragm for use in preferred embodiments of the present invention.

The process of FIG. 8-(A) to 8-(C) is preferably the same as the process of FIG. 3-(A) to 3-(C), and a description thereof will be omitted. After the oxidation film 53 is formed in the silicon substrate, only the oxidation film 53 is selectively etched by a dry etching method using an HF-etchant or an F-etchant. As a result, the depression 55 is formed on the diaphragm substrate 5 as shown in FIG. 8-(D).

Thereafter, impurity atoms are implanted without removing the remaining buffer oxidation film 50 and the remaining nitride film 51. That is, the remaining buffer oxidation film 50 and the remaining nitride film 51 are used as mask layers so that opposite edges of the boron diffusion layer 56 which defines the diaphragm 6 are automatically aligned with edges of the mask layers in a direction of implantation as shown in FIG. 8-(D). Accordingly, there is no need to form a mask layer exclusive for the implantation process, and, thus, the process is simplified and the manufacturing cost is greatly reduced. Thereafter, the diaphragm 6 is formed by the process of FIG. 8-(E) and 8-(F) which is the same as the process of FIG. 7-(E) and 7-(F).

To According to the thus-formed boron diffusion layer 56, warpage generated in the silicon substrate is smaller than warpage generated in the silicon substrate that is formed by the process shown in FIG. 7 since the boron diffusion layer is not formed over the entire surface. That is, a stress generated in the silicon substrate is limited to an area where the boron diffusion layer 56 is formed, and, thereby warpage of the silicon substrate is reduced. The above mentioned process can be applied to a structure in which the diaphragm substrate 5 is flat as shown in FIG. 1A and the depression 2 is formed in the electrode substrate 1.

A description will now be given, with reference to FIG. 9, of another process of forming the diaphragm substrate 5 which has the depression 55 to define the small gap G between the electrode and the diaphragm, according to a preferred embodiment of the present invention.

Figure 9:
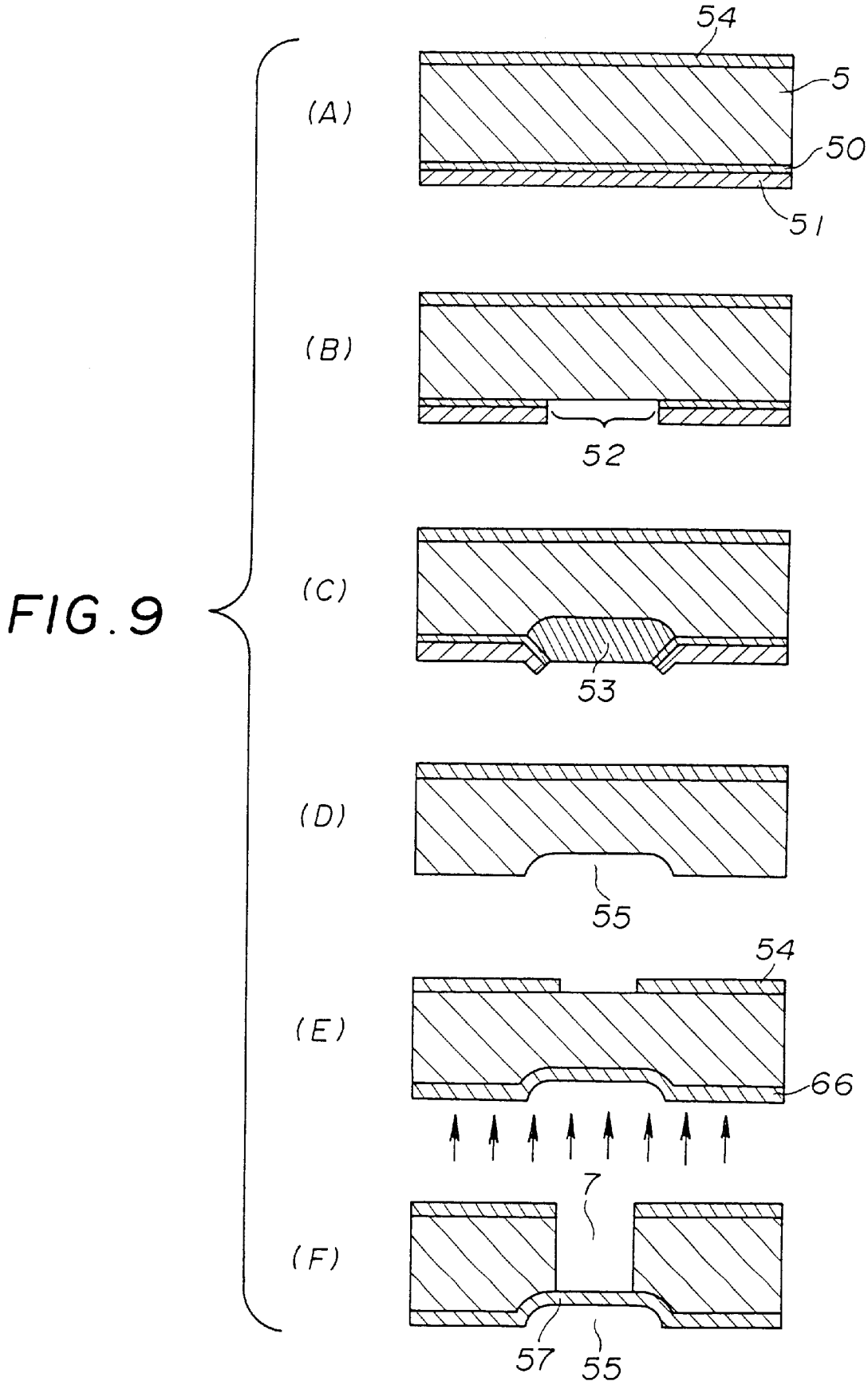
FIG. 9 is an illustration for explaining another process of forming the diaphragm substrate which has the depression to define the small gap between the electrode and the diaphragm for use in preferred embodiments of the present invention.

The process of FIG. 9-(A) to 9-(D) is preferably the same as the process of FIG. 3-(A) to 3-(D), and a description thereof will be omitted. After the depression 55 is formed on the diaphragm substrate 5, a phosphorus (P) diffusion layer 66, which is an n-channel impurity diffusion layer, is formed on an entire bottom surface of the diaphragm substrate 5. The phosphorus diffusion layer 66 functions as an etching prevention layer when the diaphragm 57 is formed by an electrochemical anisotropic etching (ECE) method. Thereby, the diaphragm 57 can be formed to have a uniform thickness.

The phosphorus diffusion layer 66 can be formed by a normal impurity diffusion method. If a gas diffusion method is used, the following process is preferably performed.

First, the diaphragm electrode 5 is placed in a diffusion furnace. Phosphine gas ($PH_3$) and oxygen gas ($O_2$) are introduced into the diffusion furnace with nitrogen gas ($N_2$) as a carrier gas so as to perform a phosphorus deposit at 1,100° C. for a predetermined period. Thereafter, activation within an oxygen atmosphere is performed so as to form the phosphorus diffusion layer 66. The phosphorus diffusion layer 66 can also be formed by ion implantation with a drive voltage of 100 KeV and a diffusion temperature of 1,000° C. The concentration of phosphorus atoms is preferably more than $1\times10^{18}$ atoms/cm$^3$, and a thickness of the phosphorus diffusion layer 66 is preferably about 1 $\mu$m to about 10 $\mu$m. In a case in which the concentration of the phosphorus atoms is high and a depth of the doping is large, that is, the diaphragm is thick, a gas diffusion by an ion implantation, a spin coating of phosphorus oxide ($P_2O_5$) or a solid phase diffusion method using a phosphorus diffusion source may be suitable.

Thereafter, an opening is formed in the mask layer 54 which is formed on a surface opposite to the surface on which the phosphorus diffusion layer 66 is formed. The pattern of the opening corresponds to the pattern of the diaphragm 57 to be formed. Thereafter, the silicon substrate under the opening is removed by an electrochemical anisotropic etching (ECE) method. The ECE method is an alkaline etching method which is performed while a reverse bias voltage is applied between the p-channel substrate and the phosphorus diffusion layer 66 (corresponding to an n-channel impurity layer). That is, when the etching of the p-channel substrate progresses and the phosphorus diffusion layer 66 (n-channel impurity diffusion layer) is exposed to the etchant, an oxidation film is formed on a surface of the n-channel impurity diffusion layer due to a difference in an oxidation potential between a p-channel semiconductor and an n-channel semiconductor so that the etching is automatically stopped at the oxidation layer. It should be noted that a potassium hydroxide (KOH) solution (10–450 wt %) is preferably used as the etchant, and the etching is preferably performed at a temperature of about 80° C. to about 90° C. and providing a reverse bias voltage of about 1 V to about 4 V.

A description will now be given, with reference to FIG. 10, of another process of forming the diaphragm on the diaphragm electrode 5 according to a preferred embodiment of the present invention.

In the above-mentioned process, the phosphorus diffusion layer 66 is preferably formed on an entire surface of the silicon substrate. On the other hand, in the process shown in FIG. 10, a diffusion layer is formed in an area which corresponds only to the location of the diaphragm 56.

Figure 10:
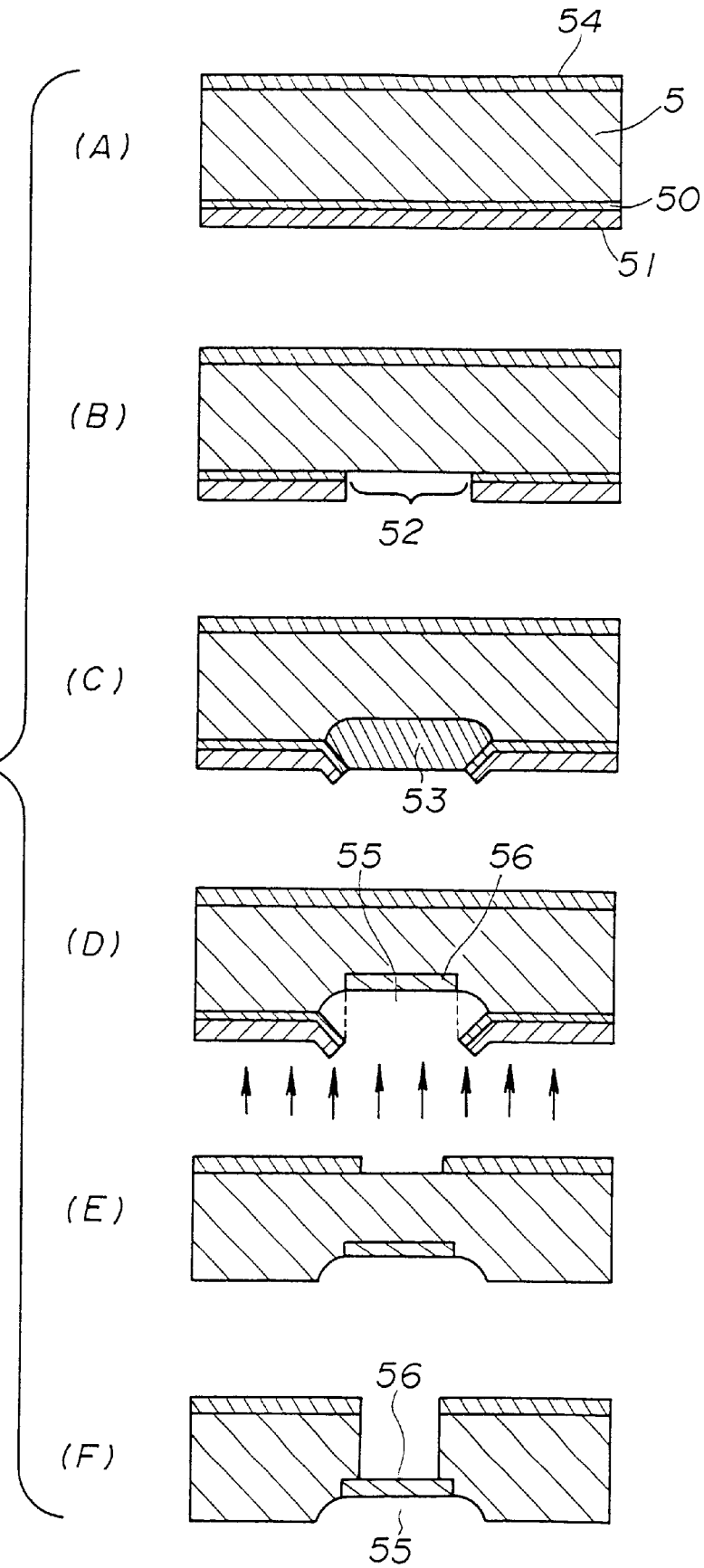
FIG. 10 is an illustration for explaining a process of forming the diaphragm on the diaphragm electrode for use in preferred embodiments of the present invention.

The process of FIG. 10-(A) to 10-(C) is preferably the same as the process of FIG. 3-(A) to 3-(C), and a description thereof will be omitted. After the oxidation film 53 is formed in the silicon substrate, only the oxidation film 53 is selectively etched by a dry etching method using an HF-etchant or an F-etchant. As a result, the depression 55 is formed on the diaphragm substrate 5 as shown in FIG. 10-(D).

Thereafter, impurity atoms are implanted without removing the remaining buffer oxidation film 50 and the remaining nitride film 51. That is, the remaining buffer oxidation film 50 and the remaining nitride film 51 are used as mask layers so that opposite edges of the phosphorus diffusion layer 66 which defines the diaphragm 56 are automatically aligned with edges of the mask layers in a direction of implantation as shown in FIG. 10-(D). Accordingly, there is no need to form a mask layer exclusively for the implantation process, and, thus, the process is simplified and a manufacturing-cost is reduced. Thereafter, the diaphragm 56 is formed by the process of FIG. 10-(E) and 10-(F) which is the same as the process 5 of FIG. 8-(E) and 8-(F).

According to the thus-formed diaphragm 56 (the phosphorus diffusion layer), a yield rate of the diaphragm substrate 5 is greatly increased. In the present process, the phosphorus diffusion layer is formed in an area corresponding to the diaphragm 56. In order to effectively use the ECE method, a p-n junction must be positively formed. If a leak current flows through the pn-junction, an oxidation occurs in the p-channel layer before the etching proceeds to the n-channel layer which results in a stop of the etching. A number of defects in the p-n junction increases exponentially as an area of the p-n junction increases. Accordingly, it is extremely difficult to form an n-channel impurity diffusion layer without defects. If the n-channel impurity diffusion layer is formed only in an area corresponding to a location of the diaphragm, formation of the p-n junction can be limited in that area which results in a great increase in a yield rate of the diaphragm substrate 5.

It should be noted that the above mentioned process can be applied to a structure in which the diaphragm substrate 5 is flat as shown in FIG. 1A and the depression 2 is formed in the electrode substrate 1.

Figure 11:
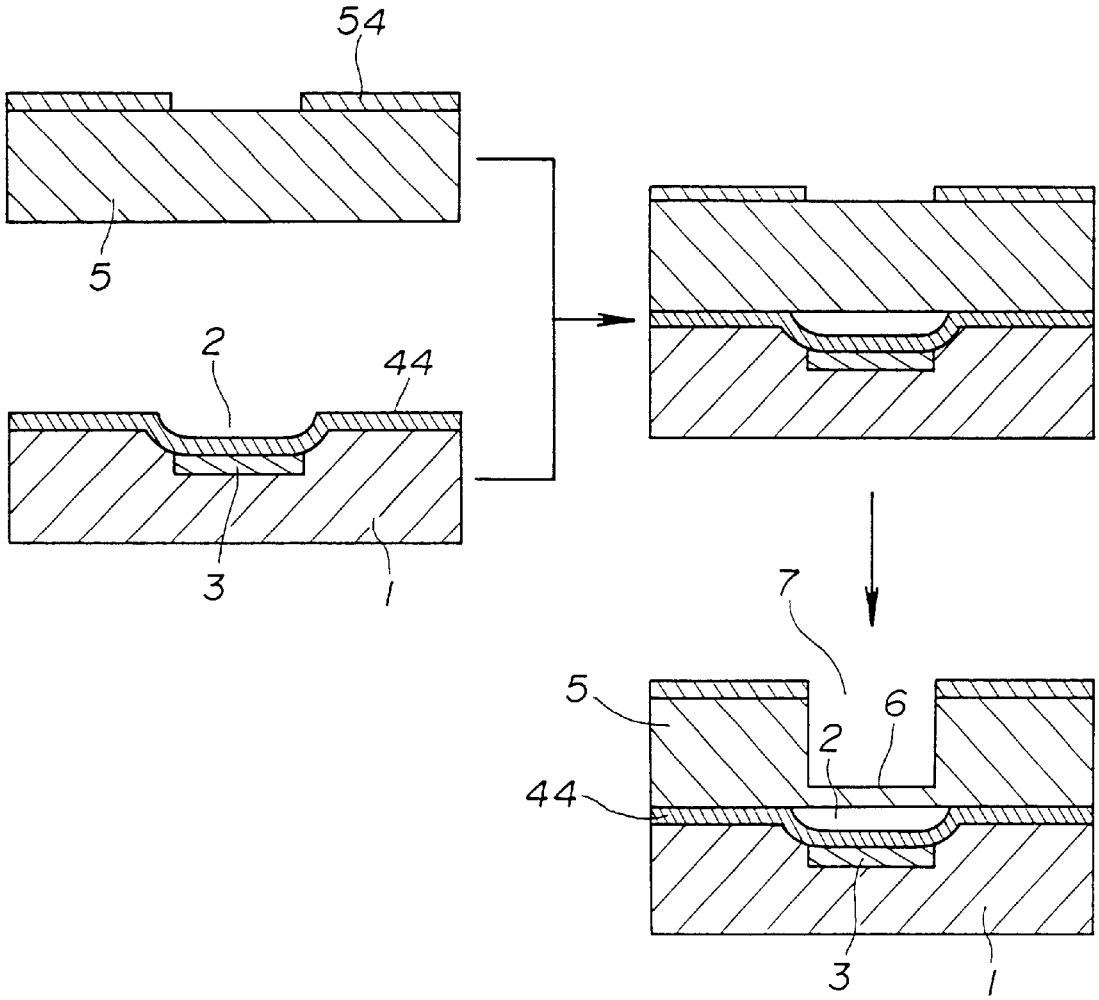
FIG. 11 is an illustration for explaining a process of forming the diaphragm in a state in which the diaphragm substrate is bonded to the electrode substrate for use in preferred embodiments of the present invention.

A description will now be given, with reference to FIG. 11, of a process of forming the diaphragm in a state in which the diaphragm substrate is bonded to the electrode substrate 1 according to a preferred embodiment of the present invention.

In this process, the diaphragm 6 is formed in the diaphragm substrate 5 by an etching method after the diaphragm substrate having the mask layer 54 is bonded to the electrode substrate 1. According to this process, the diaphragm substrate 5 can be handled as a bulk unit in a manner similar to a normal wafer. Thus, there is less possibility of being damaged during handling which increases a yield rate of the inkjet head. Additionally, deformation of the diaphragm due to heat or pressure applied during the bonding process is greatly reduced which results in a stable vibration characteristic of the electrostatic actuator.

Figure 12:
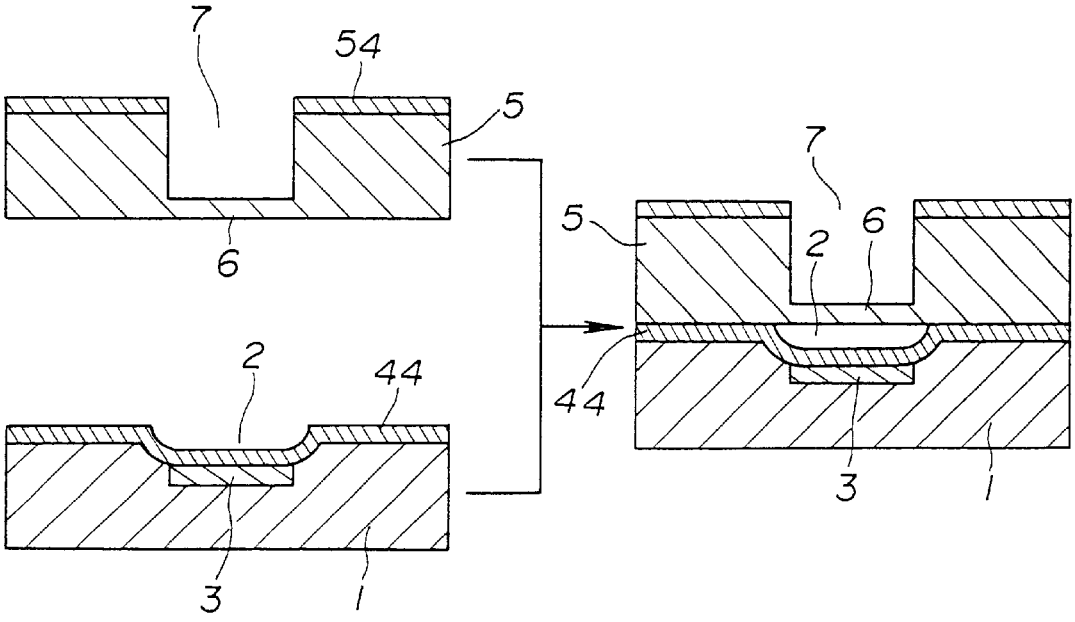
FIG. 12 is an illustration for explaining a process of bonding the diaphragm substrate to the electrode substrate for use in preferred embodiments of the present invention.

A description will now be given, with reference to FIG. 12, of a process of bonding the diaphragm substrate 5 to the electrode substrate 1 according to a preferred embodiment of the present invention.

In this process, the diaphragm substrate 5 is bonded to the electrode substrate 1 after the diaphragm 6 is formed in the diaphragm substrate 1. Since the electrode 3 is situated in the depression 2, an electrode must be extended from the electrode 3 toward outside the depression 2. Accordingly, a space defined by the depression 2 and the diaphragm 6 is not a closed space but an open space. Thus, if an etching process is performed after the diaphragm substrate 5 is bonded to the electrode substrate 1, an etchant may enter the open space in which the electrode 3 is located. The etchant can be prevented from entering the open space by sealing an opening of the open space. However, application of a sealing material may decrease a throughput of the process. However, according to the process shown in FIG. 12, there is no need to perform etching, and, thus, the above-mentioned problem can be eliminated.

The present invention is not limited to the preferred embodiments specifically disclosed herein. Variations and modifications of the preferred embodiments of the present invention may be made without departing from the scope of the present invention.

The present application is based on Japanese Priority Application No.10-269935 filed on Sep. 24, 1998, the entire contents of which are hereby incorporated by reference.

What is claimed is:

1. An ink jet head comprising:

a diaphragm substrate having a diaphragm provided therein and arranged such that said diaphragm defines a portion of a bottom surface of said diaphragm substrate; and an electrode substrate having an electrode provided therein and being attached to said diaphragm substrate so that said electrode faces said diaphragm of said diaphragm substrate, said electrode substrate having a depression therein, said depression arranged such that said electrode defines a bottom portion of said depression and a gap between said diaphragm and said electrode is defined by a depth of said depression; wherein said depression is formed by selectively oxidizing an inner portion of said electrode substrate in an oxidizing area to form an oxidation layer, and removing substantially all of said oxidation layer to form said depression, such that said gap extends into said inner portion of said electrode substrate, and wherein said substrate is substantially free of said oxidation layer adjacent said gap.

2. The inkjet head of claim 1, wherein said oxidation layer is a thermal oxidation layer having a thickness of about 0.1 $\mu$m to about 7 $\mu$m.

3. The inkjet head as claimed in claim 2, wherein said electrode is made of one of a p-channel impurity diffusion layer and an n-channel impurity diffusion layer.

4. The inkjet head as claimed in claim 3, wherein a mask layer is provided for selectively oxidizing the portion of said electrode substrate, and said mask layer is also used as a mask layer when said one of the p-channel impurity diffusion layer and the n-channel impurity diffusion layer is formed.

5. The inkjet head as claimed in claim 1, wherein said electrode substrate includes one of an oxidation film and a nitride film which covers a surface of said electrode substrate so as to protect said electrode and to facilitate bonding of said diaphragm substrate to said electrode substrate.

6. The inkjet head as claimed in claim 5, wherein said one of the oxidation film and the nitride film has a thickness of about 0.05 $\mu$m to about 0.5 $\mu$m.

7. The inkjet head as claimed in claim 1, wherein said electrode substrate includes a multi-layered film having an oxidation film and a nitride film, and the multi-layered film covers a surface of said electrode substrate so as to protect said electrode and facilitate bonding of said diaphragm substrate to said electrode substrate.

8. An ink jet head comprising:

an electrode substrate having an electrode on a top surface thereof; and a diaphragm substrate having a diaphragm provided therein, the diaphragm substrate being connected to said electrode substrate so that said electrode of said electrode substrate faces said diaphragm provided in said diaphragm substrate, said diaphragm substrate having a depression therein, said depression arranged such that said diaphragm defines a bottom portion of said depression and a gap between said diaphragm and said electrode is defined by a depth of said depression; wherein said depression is formed by selectively oxidizing an inner portion of said diaphragm substrate in an oxidizing area to form an oxidation layer, and removing substantially all of said oxidation layer to form said depression, such that said gap extends into said inner portion of said diaphragm substrate, and wherein said substrate is substantially free of said oxidation layer adjacent said gap.

9. The inkjet head as claimed in claim 8, wherein said depression has a structure defined by removing an oxidation layer formed by selectively oxidizing a portion of said diaphragm substrate and said oxidation layer is a thermal oxidation layer having a thickness of about 0.1 $\mu$m to about 7 $\mu$m.

10. The inkjet head as claimed in claim 9, wherein said diaphragm is made of one of a p-channel impurity diffusion layer and an n-channel impurity diffusion layer.

11. The inkjet head as claimed in claim 10, wherein a diffusion area defining said one of the p-channel impurity diffusion layer and the n-channel impurity diffusion layer is limited to a portion which corresponds to a location of said diaphragm.

12. The inkjet head as claimed in claim 11, wherein said portion of said diaphragm substrate is selectively oxidized by using a mask layer, and said one of the p-channel impurity diffusion layer and the n-channel impurity diffusion layer is made by using said mask layer.

13. An electrostatic actuator comprising:

a diaphragm substrate having a diaphragm formed therein such that said diaphragm defines a portion of a bottom surface of said diaphragm substrate; said an electrode substrate having an electrode provided therein, the electrode substrate being attached to said diaphragm substrate so that said electrode faces said diaphragm of said diaphragm substrate with a predetermined gap being defined therebetween, said electrode substrate having a depression therein, so that said electrode defines a bottom portion of said depression and such that said predetermined gap is defined by a depth of said depression; wherein said depression is formed by selectively oxidizing an inner portion of said electrode substrate in an oxidizing area to form an oxidation layer, and removing substantially all of said oxidation layer to form said depression, such that said gap extends into said inner portion of said electrode substrate, and wherein said substrate is substantially free of said oxidation layer adjacent said gap.

14. An electrostatic actuator comprising:

a diaphragm substrate including a diaphragm provided therein; and an electrode substrate including an electrode provided therein, the electrode substrate being attached to said diaphragm substrate so that said electrode of said electrode substrate faces said diaphragm of said diaphragm substrate with a predetermined gap being defined therebetween;

wherein said diaphragm substrate has a depression therein, so that said diaphragm defines a bottom portion of said depression and so that said predetermined gap is defined by a depth of said depression; and wherein said depression is formed by selectively oxidizing an inner portion of said diaphragm substrate in an oxidizing area to form an oxidation layer, and removing substantially all of said oxidation layer to form said depression, such that said gap extends into said inner portion of said diaphragm substrate, and wherein said substrate is substantially free of said oxidation layer adjacent said gap.

15. A method of producing an ink jet head comprising the steps of:

providing a diaphragm substrate;

providing an electrode substrate having an electrode provided therein and having a depression formed in a top surface thereof; wherein said depression is formed by selectively oxidizing a portion of said electrode substrate in an oxidizing area to form an oxidation layer, and removing substantially all of said oxidation layer to form said depression;

bonding said diaphragm substrate to said electrode substrate so that a bottom surface of said diaphragm substrate faces said electrode substrate; and forming a diaphragm in said diaphragm substrate after said diaphragm substrate is bonded to said electrode substrate so that said diaphragm includes a portion of said bottom surface of said diaphragm substrate.

16. A method of producing an ink jet head which comprises the steps of:

providing a diaphragm substrate having a depression formed in a bottom surface thereof, wherein said depression is formed by selectively oxidizing a portion of said diaphragm substrate in an oxidizing area to form an oxidation layer, and removing substantially all of said oxidation layer to form said depression;

providing an electrode substrate having an electrode provided therein;

bonding said diaphragm substrate to said electrode substrate so that said bottom surface of said diaphragm substrate faces a top surface of said electrode substrate; and forming a diaphragm in said diaphragm substrate after said diaphragm substrate is bonded to said electrode substrate so that said diaphragm includes a portion of a bottom surface of said depression.

17. A method of producing an ink jet head, the method comprising the steps of:

preparing a diaphragm substrate including a diaphragm and a pressurizing chamber which is formed so that said diaphragm defines a bottom wall of said diaphragm substrate;

preparing an electrode substrate having an electrode and a depression therein, said electrode and said depression arranged such that said electrode is formed on a bottom portion of said depression and such that a gap between said diaphragm and said electrode is defined by a depth of said depression, wherein said depression is formed by selectively oxidizing a portion of said electrode substrate in an oxidizing area to form an oxidation layer, and removing substantially all of said oxidation layer to form said depression; and bonding said diaphragm substrate to said electrode substrate so that said diaphragm faces said electrode.

18. A method of producing an ink jet head, the method comprising the steps of:

preparing an electrode substrate having an electrode on a top surface thereof;

preparing a diaphragm substrate having a diaphragm and a pressurizing chamber formed therein, said diaphragm substrate having a depression therein, said depression arranged such that said diaphragm defines a bottom of said depression and so that a gap between said electrode and said diaphragm is defined by a depth of said depression, wherein said depression is formed by selectively oxidizing a portion of said diaphragm substrate in an oxidizing area to form an oxidation layer, and removing substantially all of said oxidation layer to form said depression; and bonding said diaphragm substrate to said electrode substrate so that said electrode faces said diaphragm.

* * * * *